US005207604A

United States Patent [19]

McMillin

[11] Patent Number: 5,207,604

[45] Date of Patent: May 4, 1993

[54] BOAT AND STEERING ASSEMBLY

[76] Inventor: David A. McMillin, 9674 W. Coronado, Baton Rouge, La. 70815

[21] Appl. No.: 871,818

[22] Filed: Apr. 21, 1992

[51] Int. Cl.[5] ..... B63H 21/26

[52] U.S. Cl. ..... 440/62; 114/144 R; 114/363; 114/344; 440/6

[58] Field of Search ..... 114/343, 344, 162, 362, 114/363, 144 R; 440/6, 7, 53, 62

[56] References Cited

U.S. PATENT DOCUMENTS 2,845,891 8/1958 Frey ..... 440/62
2,912,955 11/1959 Leipert ..... 440/62
3,755,838 9/1973 Dunagan ..... 114/344
3,865,335 2/1975 Roller et al. ..... 440/62
4,022,145 5/1977 Tindal ..... 440/62
4,723,500 2/1988 Havins ..... 440/7

*Primary Examiner*—Jesûs D. Sotelo
*Assistant Examiner*—Stephen P. Avila
*Attorney, Agent, or Firm*—William David Kiesel; Robert C. Tucker; C. Dean Domingue

[57] ABSTRACT

A vessel and a steering mechanism for the vessel is disclosed. In one embodiment, the vessel comprises a hull, a motor apparatus for providing propulsion to the hull, a pedestal mounted within the hull, and a pulley device, operably connected to the pedestal, for steering the vessel. The pulley device may comprise a first, second and third rimmed disc which are interconnected by cable means.

7 Claims, 2 Drawing Sheets

BOAT AND STEERING ASSEMBLY

BACKGROUND OF THE INVENTION

This invention relates to boats and vessels. More particularly, but not by way of limitation, this invention relates to a fishing boat and steering mechanism for the boat.

The prior art dealing with fishing vessels has attempted several designs which deal with steering mechanisms. One such design is seen in U.S. Pat. No. 4,734,066 to Burgess, which discloses a trolling motor elevating apparatus which contains a rotatable foot control pad mounted on the boat deck.

In U.S. Pat. No. 3,072,090 to Yarbrough, the patent discloses a portable outboard propulsion for use with a boat powered by an inboard engine and having an inboard drive shaft. Also described in the prior art is a marine propulsion unit which contains a drive arrangement and a gear arrangement for the propulsion unit.

In U.S. Pat. No. 4,668,195 to Smith there is described therein a bow motor assembly and motor lift mechanism wherein the motor assembly is mounted on a housing in the bow of the boat. Baldwin, in U.S. Pat. No. 3,807,347, describes a fully retractable drive unit of a drive system for mounting on a hull.

As will be appreciated by those of ordinary skill in the art, when the operator of the fishing boat is actually fishing, many times propulsion means is actually still required; however, steering of the boat during this time is difficult with the designs of the prior art. As can be seen from the above, there is a need in the industry for a steering mechanism for an apparatus which will allow the operator, who is fishing, to continue movement, while at the same time control the direction of the boat. In combination with this type of steering mechanism, there is a need for the propulsion means to be retractable when the boat is actually on the water or being transported or stored.

SUMMARY OF THE INVENTION

The present invention includes apparatus claims for a boat and steering assembly. The boat comprises a hull, a seat mounted within the hull, motor means for providing propulsion to the boat, and steering means, which is connected to the seat, for steering the hull. In one embodiment, the motor means is an electric troll type motor, and the boat will also contain electric activation means for activating the motor from an "off" position, to an "on" position. The motor means is also retractable from a position within the hull, to a position exterior of the hull so that the motor means is effectively in contact with the water.

The invention may further include retractable wheel means, connected to the bow of the hull, for transporting the boat on dry land or for aid in loading or unloading the boat from a trailer.

Lock means may also be employed for locking the motor means in an upright position so that the motor means is out of the water. The boat can be designed such that the total length is less than eight feet, so that the entire apparatus can fit into the back end of a pick-up truck.

In the preferred embodiment, the steering means includes a first, second, and third pulley, also known as rimmed discs, of which the first and second pulley are connected to the motor means. The third pulley is connected to the seat. Also included as part of the steering mechanism is cable means for interconnecting the first, second and third pulley's.

One embodiment of the third pulley comprises a disc with a bored aperture in the center. The disc will have a first and second side, and a rimmed periphery which will contain the cable means. The first side is rotatively connected or mounted to the hull of the boat. The second side has contained thereon a cavity portion shaped as a square, with the center of the cavity being in communication with the aperture.

A cylindrical member is also included, with the cylindrical member having a first end and a second end, with the first end being operably associated with the seat and the second end having disposed thereon an octagon base sized so that four sides of the octagon base are in contact with the four sides of the squared removed portion of the second side of the disc.

The invention may also include electric battery supply means for supplying electric power to the electric operated motor. Foot activation means may also be employed to activated the battery supply means.

A feature of the present invention is the novel steering mechanism which utilizes the three pulley members. Another feature of the invention is having the three pulley members being interconnected with the cable means, thus imparting movement in phase to all three members.

Yet another feature is connecting the seat in which the operator is seated with the third pulley member. Still another feature is having a shaft member connecting the seat with the pulley, and wherein the shaft member has a octagon shaped end which will cooperate with the cavity member of the third pulley.

Another feature of the invention is the retractable motor means. Still another feature of the invention is the use of electric motors. Yet another feature is the use of lock means to position the motor means in a position wherein the propeller and shaft and propeller are secured within the hull. Another feature includes the use of retractable wheel means for the ease of transporting the boat from storage to the water.

An advantage of the present invention is that the operator can navigate the vessel while positioned in the seat. Another advantage is the simplicity of design which allows for compact utilization of space. Another advantage is the ability to use the invention with a boat and motor for navigation purposes while fishing, while having a second more powerful engine for travelling longer distances in a shorter time period. Yet another advantage is the ability to use the invention at the bow of the boat, and allowing the use of a more powerful engine in the conventional space at the stern of the boat.

DESCRIPTION OF THE PREFERRED EMBODIMENT

Figure 1:
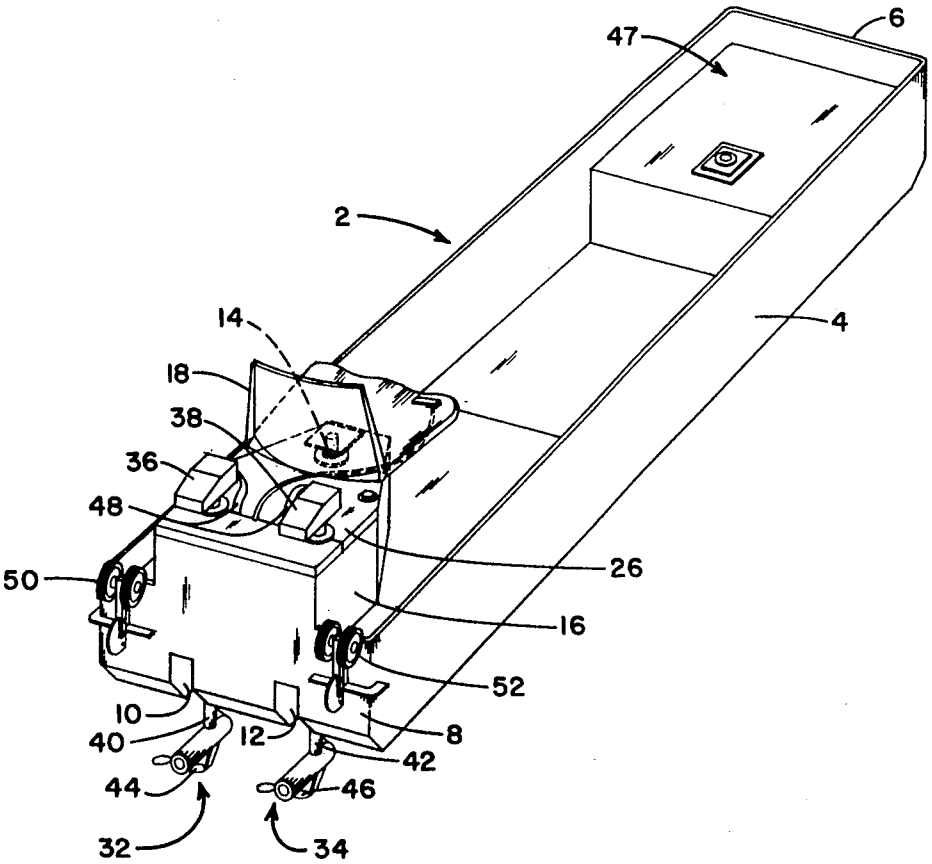
FIG. 1 is a three-dimensional view depicting the boat and motor of the present invention.

Referring to FIG. 1, one embodiment of the boat 2 is shown. The boat 2 will comprise a hull 4 having a bow 6 and stern 8. The hull will have contained thereon a first slotted opening 10 and a second slotted opening 12.

The hull will have attached thereto a pedestal 14 which will be attached at one end to the housing member 16. Attached to the other end of the pedestal 14 is the seat 18.

Figure 2:
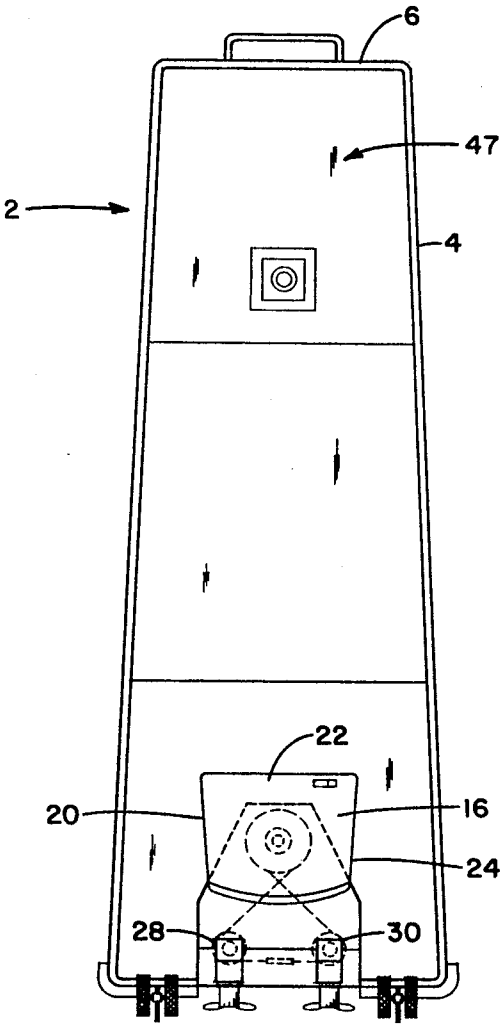
FIG. 2 is a top-view of the boat and boat deck as seen in FIG. 1.

Referring to FIG. 2, the housing member 16 will have a first side 20, second side 22, and third side 24. The housing member will also contain a top portion 26, with the top portion having a first chamber 28 and a second chamber 30. Contained within chamber 28 and 30 will be first motor means 32 and second motor means 34, as better seen in FIG. 1.

In the preferred embodiment, the motor means 32 and 34 will be electrically operated so that a battery supply means (not shown) will supply power to the motor means 32, 34. The motor means 32, 34 will include engines 36, 38, shafts 40,42 and propellers 44,46. As illustrated in the figures, two engine means have been utilized; however, it should be understood that the invention is applicable to a boat wherein only one engine is utilized, or alternatively, three engines are employed. Also, gas powered engines may be employed, depending on the preference of the operator. It should also be noted that the invention is generally positioned at the stern of the boat as seen in FIG. 1; however, the invention may also be positioned in the general area of the bow as shown by the numeral 47. Utilizing the area 47 as shown in FIGS. 1 and 2 would allow the use of a conventional engine at the stern.

Returning to FIG.1, electrical wiring means 48 are employed in order to supply the electrical power from the battery means 36 to the engines 36,38. Also shown are retractable wheel means 50,52 which are shown in the position wherein the wheel means can be utilized for transporting the boat 2 from a trailer to a body of water.

Figure 3:
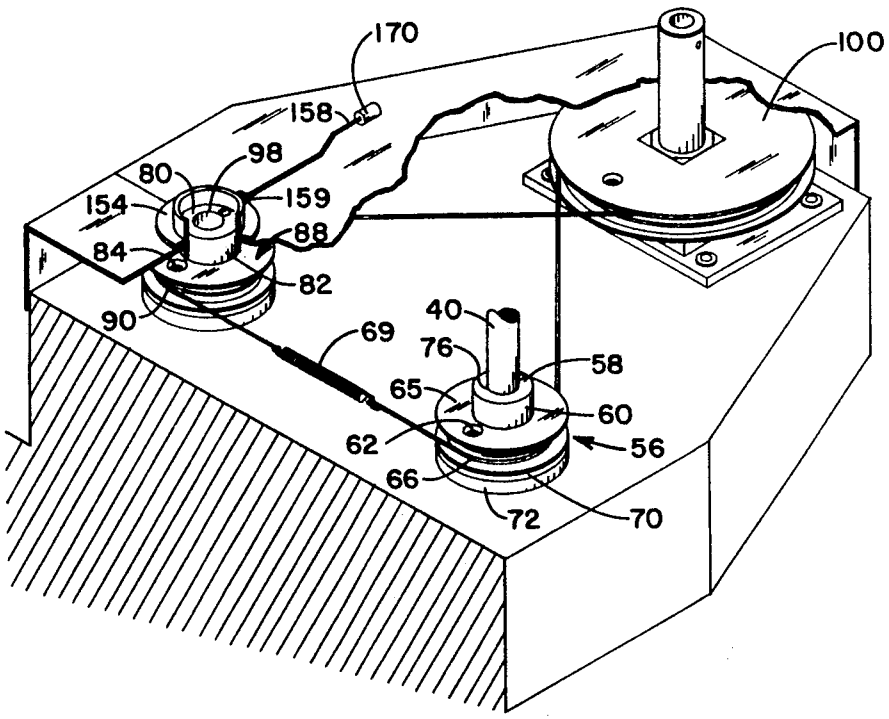
FIG. 3 is a three-dimensional view of the steering mechanism.

Referring to FIG. 3, the pulley means 54 for steering the motor means 32,34 is depicted. The pulley means 54, which can also be referred to as the steering apparatus, will have a first rimmed disc 56 which is of general cylindrical configuration having a first radial surface 58 which extends to cylindrical surface 60. Cylindrical surface will have contained thereon an opening 62 for placement of a set screw. The purpose of the set screw is to clamp down on the cable to prevent slippage. Surface 60 terminates at radial surface 65, which in turn, will lead to rimmed surface 66 which will contain cable means 68, which also contains spring adjusting means 69 which allow for variable tension of the cable 68, as well as allowing for ease of attaching the cable. The rimmed surface 66 will terminate at teflon washer 70, which in turn will extend to guide collar 72 (seen in FIG. 4).

Cylindrical surface 72 terminates at radial surface 74. Extending radially inward, the first rimmed disc 56 contains bore 76 which have disposed therein the shaft 40 of the motor means 34.

The second rimmed disc 78 is similar in design to the first rimmed disc 56. The disc 56 will comprise a first radial surface 80 which extends to cylindrical surface 82. Cylindrical surface 82 will have contained thereon an opening 84 for placement of a securing means, such as a set screw 86. Surface 82 terminates at radially flat surface 88 which in turn will lead to rimmed surface 90, with rimmed surface also containing therein the previously mentioned cable means 68. The rimmed surface 90 will conclude at radial flat surface 92, which in turn will extend to cylindrical surface 94 (as seen in FIG. 4).

The surface 94 concludes at radial surface 96. Extending radially inward, the second rimmed disc 78 will contain a bore 98 which will have disposed therein the second motor means 34. Spacer 97 and guide collar 99 is also included.

The third rimmed disc 100 is also attached to the housing member 16, and the third rimmed disc is disposed in relation to the first and second rimmed discs 56,78 at a position wherein the disc 56, 78 are aligned and parallel with the stern of the boat, and the third rimmed disc is positioned in the hull, at a point aft of the bow, so that the three rimmed disc form a triangular spaced pulley means.

Figure 4:
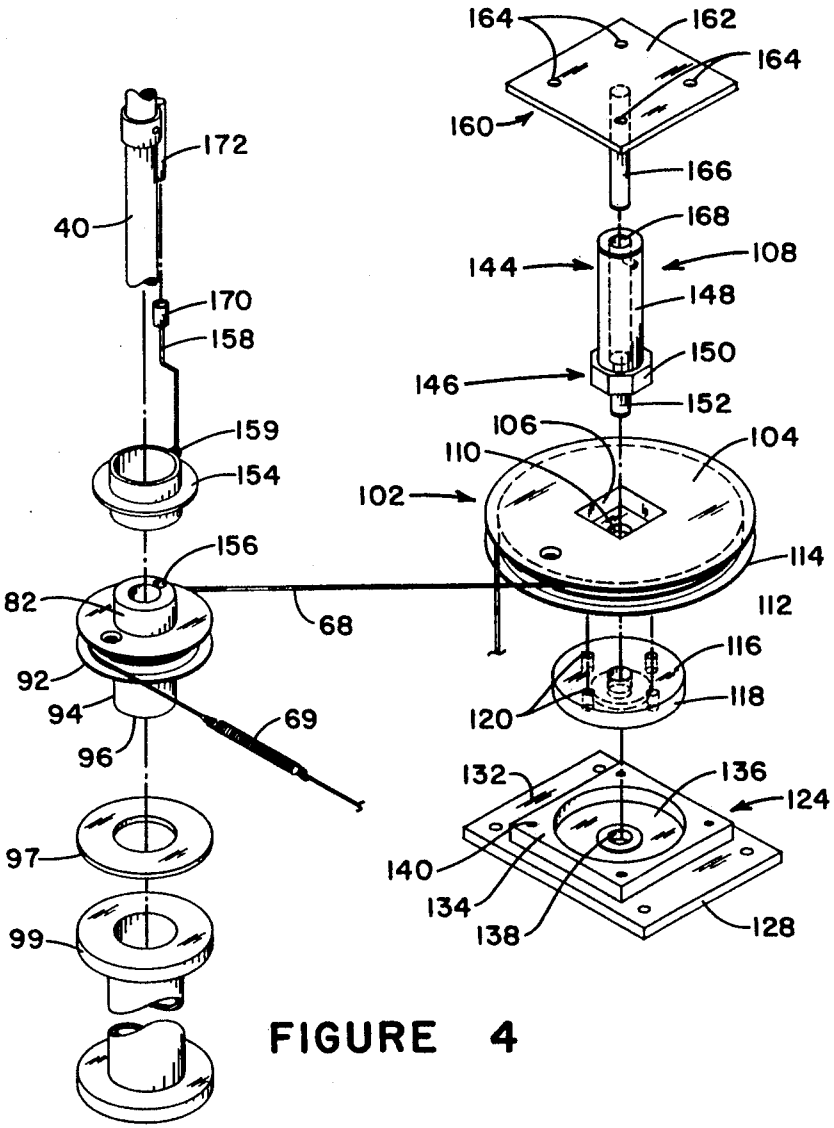
FIG. 4 is a three-dimensional, disassembled view of the steering rimmed disc.

Referring to FIG. 4, the third rimmed disc 100 will now be described. The cylindrical member 102 will contain a first surface 104 which will have defined therein cavity 106, with the cavity 106 having a square configuration and sized to receive an octagon insertion member 108 so that four sides of the octagon member engage the four sides of cavity 104. The cylindrical member has a center opening 110, which is in communication with the cavity 104.

The first surface 104 will, in turn, lead to the rimmed surface 112 which will contain the cable means 68. The rimmed surface concludes at second surface 114, of which second surface extends to shoulder 116, which in turn extends to third surface 118. Surface 118 will have a plurality of openings 120 for placement of securing devices 122 (not shown).

The cylindrical member 102 will be slidably disposed within the plate structure 124, with the plate structure 124 being attached to the housing member 16. The plate structure 124 has first side 126, second side 128, third side 130 and fourth side 132, as well as surface 134. The surface 134 has disposed therein circular cavity 136 which will cooperate and engage the shoulder 116 and surface 118 of cylindrical member 102.

The plate structure 124 will also have a center opening 138 which is aligned with the opening 110 of the cylindrical member. The plate structure will also contain a plurality of openings 140 which will have positioned therein securing means 142 (not shown) for securing the plate structure to the housing member 16.

The insertion member 108 generally comprises a first end 144 and a second end 146. The first end will be connected to seat means 18 for the operator to sit, steer the boat and fish in accordance with the teachings of the present invention. The insertion member has a cylindrical surface 148 which extends from the first end 144 to the second end 146.

In the preferred embodiment, the second end 146 will have contained thereon an octagon shaped base 150 which will be received within the previously described cavity 106. Extending below base 150 is cylindrical support means 152 which will be inserted into the center opening 110.

Also shown in FIG. 4 is locking disc 154 which will have identical components on the other shaft members but are not shown in the drawings. The locking disc 154 will be slidably disposed about surface 82. The purpose of the locking disc 154 will be to engage the motor means 36,38 in an up position when not in use, and also, when the motor means 36,38 are in use, to lock the shafts 40,42 of the motor means in the discs 56,78 (also referred to as the pulley means) so that the discs, as it is rotated will in turn rotate the shaft member.

The locking member 158, which will be pivotally attached at 159 to locking disc 154, will cooperate with the aforementioned locking collar to lock the motor in a position so that propellers are positioned within the hull 4. The locking member 158 has at one end a hollow cylindrical head 170. As seen in FIG. 4, the shaft 40 will contain a locking collar 172 with aperature for placement of a retaining pin, which will contain the head portion 170 when the motor is in the locked up position i.e. propellers in the hull 4.

In the preferred embodiment, the first end of the insertion member 144 will be attached to the base 160 of the seat 18, the base 160 containing a rectangular surface 162 containing a plurality of apertures 164 for placement of securing devices (not shown) for securing the base 160 to the actual seat 18. The base has extending therefrom cylindrical member 166 which will be fixedly disposed within the bore 168 of the insertion member 108.

In operation of the invention, the operator may navigate the direction of the boat by simply turning in the seat 18. Thus, if the operator is fishing, while positioned in the seat, the operator does not need to store his fishing rod and reel. Instead, the operator orients the seat in the direction the operator wishes to travel.

The insertion member is utilized by removing the octagon shaped base 150 from the cavity 136, and re-aligning the octagon base 150 so that a different angle of inclination is obtained. By doing so, the operator, while positioned in the seat, can be facing the bow, stern, port or starboard, and from that angle, still navigate the boat as if the operator were seated, facing the bow of the boat.

By utilizing this feature, the operator can fishing along side a bank in a river, and the operator can be facing the starboard side of the boat; however, the steering mechanism will allow that the boats direction will be parallel with the bank since the insertion member was aligned in that angle of inclination.

Changes and modifications in the specifically described embodiments can be carried out without departing from the scope of the invention which is intended to be limited only by the scope of the appended claims.

I claim:

1. A boat and motor assembly comprising:

a hull with at least one opening formed therein;

first and second motor means for providing propulsion to the boat, and wherein said motor means includes an engine, a shaft member extending from the engine through said opening in the hull, and a propeller attached to the shaft;

a seat mounted on a pedestal in the hull;

pulley means, operably connected to the pedestal, for steering said motor means so that as the seat is turned, said pulley means imparts rotative movement to said motor means, and wherein said pulley means comprises:

a first rimmed disc having a passageway formed through the center thereof, and wherein said shaft of said first motor means is disposed therethrough;

a second rimmed disc having a passageway formed through the center thereof, and wherein said shaft of said second motor means is disposed therethrough;

a third rimmed disc having a passageway formed through the center thereof, and wherein said pedestal is disposed therein;

cable means for interconnecting said first, second and third rimmed wheels;

retractable wheel means, mounted on the stern of the boat, for transporting the boat on dry land; and retracting means, mounted on said hull, for retracting said first and second motor means from a position within said hull to a position outside said hull.

2. The assembly of claim 1, wherein said third rimmed disc comprises a pulley member having a rimmed outer periphery for placement of the cable means, and said pulley member having a first side and a second side, wherein said first side being rotatively connected to the hull of the boat, and said second side containing a squared removed portion being in communication with the aperture;

and said pedestal comprises:

a cylindrical member having a first end and a second end, said first end being operably associated with said seat and said second end having disposed thereon an octagon portion sized so that four sides of the octagon portion are in contact with the four sides of the squared removed portion of the second side of the pulley member.

3. The assembly of claim 2, wherein said retractable motor means further comprising:

lock means for locking the motor means in an upright position so that the motor means is out of the water, and wherein the length of the boat, from the bow to the stern is eight feet.

4. The assembly of claim 3, wherein said first and second motor means is an electric operated motor and shaft, and wherein the assembly further comprises:

electric battery supply means for supplying electric power to said electric operated motor; and, foot pedal activation means for activating said first and second motor means with power from said battery supply means, said foot pedal activation means containing an elongated bar positioned about said seat and pedestal.

5. A steering apparatus for a vessel, comprising:

a housing member having a first, second and third opening;

a first circular member engaged within said first opening and having a passageway defined in the center, and wherein said first circular member comprises a first and second end, and wherein the first end has formed on the outer periphery a grooved surface and wherein the second end is rotatively disposed within said first opening of the housing member;

a second circular member engaged within said second opening and having a passageway defined in the center, and wherein said second circular member comprises a first and second end, and wherein the first end has formed on the outer periphery a grooved surface and wherein the second end is rotatively disposed within said second opening of the housing member;

a third circular member engaged within said third opening and having a passageway defined in the center, and wherein said third circular member comprises a disk with a bored apertured contained therein, said disc having a first side, a second side, and a rimmed periphery, said rimmed periphery containing said cable means, said first side being rotatively connected to said housing member, and said second side containing a squared removed portion being in communication with the aperture;

a first and second propulsion means, disposed within the passageway of said first and second circular member;

seat means, operably connected to said third circular member, for rotational control of the third circular member; and cable means, operably connected to said first, second and third circular member, for imparting rotative movement from said third member to said first and second circular members; and a cylindrical member having a first end and a second end, said first end being operably associated with a steering mechanism and said second end having disposed thereon an octagon portion sized so that four sides of the octagon portion are in contact with the four sides of the squared removed portion of the second side of said disc.

6. The apparatus of claim 5 wherein said motor propulsion means is an electric powered motor; and further comprising:

activation means, mounted on said housing member, for supplying electrical power to said propulsion means and activating said electric motor;

lock means for locking the motor means in an upright position so that the motor means is out of the water.

7. A boat, comprising:

a hull;

a seat mounted within said hull;

steering means, operably connected to said seat, for steering said hull including a first and second circular member;

motor means, operably connected to said steering means, for providing propulsion to said hull, said motor means containing thereon a shaft, with said shaft being disposed within said second circular member;

cable means, interconnecting said first and second circular member, for imparting rotative movement from said first circular member to said second circular member; wherein said first circular member comprises a disc with a bored aperture contained therein, said disc having a first side, a second side, and a rimmed periphery, said rimmed periphery containing said cable means, said first side being rotatively connected to the hull of the boat, and said second side containing a squared removed portion being in communication with the aperture; and an insertion member having a first end and a second end, said first end being operably associated with said seat and said second end having disposed thereon an octagon base sized so that four sides of the octagon base are in contact with the four sides of the squared removed portion of the second side of said disc.

* * * * *